United States Patent [19]

Norz

[11] 4,312,290

[45] Jan. 26, 1982

[54] STITCH SHORTENING AND TACKING ASSEMBLY FOR BLINDSTITCH SEWING MACHINES

[75] Inventor: Wolfgang Norz, Schwieberdingen, Fed. Rep. of Germany

[73] Assignee: Union Special G.m.b.H., Stuttgart, Fed. Rep. of Germany

[21] Appl. No.: 154,657

[22] Filed: May 30, 1980

[30] Foreign Application Priority Data

Jun. 9, 1979 [DE] Fed. Rep. of Germany ..... 2923449

[51] Int. Cl.[3] ..... D05B 27/22

[52] U.S. Cl. ..... 112/178; 112/315

[58] Field of Search ..... 112/315, 314, 316, 317, 112/303, 178, 176

[56] References Cited

U.S. PATENT DOCUMENTS 2,333,128 11/1943 Stevenson ..... 112/315 X 2,763,225 11/1956 Mensching ..... 112/178

4,114,547 9/1978 Russell ..... 112/178

*Primary Examiner*—H. Hampton Hunter

*Attorney, Agent, or Firm*—John W. Harbst; John A. Schaerli

[57] ABSTRACT

This invention relates to a feed mechanism for a blindstitch sewing machine including a stitch shortening and tacking mechanism. Elliptical feeding movement is imparted to the feed dog by a fulcrumed lever driven off an eccentric on the main shaft of the machine. An operator controlled eccentric actuator is operatively connected to mechanism which changes the fulcrumed position of the feed lever to vary the elliptical path of the feed dog whereby effecting the advancement of the workpiece during the sewing operation without effecting needle reciprocation. An auxiliary thread tensioning assembly is provided to control the amount of thread utilized during the stitch tacking operation.

6 Claims, 5 Drawing Figures

STITCH SHORTENING AND TACKING ASSEMBLY FOR BLINDSTITCH SEWING MACHINES

FIELD OF THE INVENTION

This invention relates to blindstitch sewing machines and more particularly, to a mechanism for use with such a machine for effecting a stitch shortening and tacking operation at the will of the operator.

BACKGROUND OF THE INVENTION

A blindstich sewing machine produces a chainstitch which has the inherent disadvantage that it easily unravels. Thus, there is an advantage in providing a blindstich sewing machine with means for effecting a tacking or locking operation at the end of the sewing operation, thus preventing the seam from unraveling. By reason of the special and unique construction of a blindstitch sewing machine, conventional arrangements for stitch shortening or tacking that have been used on other types of machines cannot be transferred for this purpose to blindstitch sewing machines.

A blindstitch sewing machine with a tacking or seam locking means is disclosed in the U.S. Pat. No. 4,114,547, issued to R. Russell. This patented apparatus accomplishes the tacking effect by providing a device which lowers the work support without lowering the ridge former. By lowering the work support during sewing, there will be no feeding effect on the workpiece and, thus, a series of stitches may be secured in the workpiece within a relatively short distance. A number of stitches formed in generally the same area, will provide a locking effect on the seam. The disadvantage of the patented apparatus is that the workpiece is inadequately clamped when the work support is lowered. Thus, the needle may fail to pierce the workpiece and, thus, an unacceptable garment may result.

A SUMMARY OF THE INVENTION

In view of the above, and in accordance with the present invention, there is provided a mechanism which serves the purpose of shortening the stitch length of a blindstitch sewing machine so as to allow a tacking or locking operation without effecting the manner in which the workpiece is presented to the reciprocating needle. The problem with known mechanism is overcome by continually supporting the workpiece but effectively disengaging the work advancing mechanism so that the workpiece is held generally stationary, thus allowing successive penetrations by the needle in a shortened area, thus securing the seam.

To accomplish this end, the present invention includes a fulcrumed lever means that has a feed dog secured to one end for engaging the workpiece and means for converting rotational movement of the machine mainshaft into elliptical movement of the feed dog whereby intermittently advancing the workpiece through a predetermined distance. Arranged for rotation in the free ended arm of the machine is an eccentrically apertured sleeve means adapted to receive a pin. Operator controlled means are arranged in operative engagement with the sleeve and are adapted to turn the sleeve a controlled amount whereby displacing the pin because of its eccentricity relative to the rotational axis of the sleeve. Interconnecting the eccentrically arranged pin and lever is a lever element that effectively displaces the fulcrum of the lever when the sleeve is rotated. Displacement of the fulcrum alters the ffectiveness of the feed dog on the workpiece such that the workpiece is moved through a shortened distance. Shortening of the stitch length allows a greater number of stitches to be secured in a shortened area in the workpiece whereby preventing seam unraveling. An auxiliary thread tension assembly is also provided to control excess thread caused by the reduction in the amount of the material feed while the stitch length is shortened.

In line with all of the above, it is a primary object of this invention to provide a combination stitch shortening and tacking assembly for a blindstitch sewing machine.

It is another object of this invention to provide an improved feed mechanism for a blindstitch sewing machine capable of varying the stitch length at the will of the operator.

Another object of this invention is the provision of a combined stitch shortening and tacking assembly that maintains the workpiece in a constant disposition relative to the needle during the tacking operation.

BRIEF DESCRIPTION OF THE DRAWINGS

Having in mind the above objects and other attendant advantages that would be evident from an understanding of this disclosure, the invention comprises the devises, combinations, and arrangements of parts as illustrated in the presently preferred embodiment of the invention which is hereinafter set forth in detail so as to enable those skilled in the art to readily understand the functions, operation, construction and advantages of it when read in conjunction with the accompanying drawings in which.

DETAILED DESCRIPTION OF THE PRESENTLY PREFERRED EMBODIMENT

Figure 1:
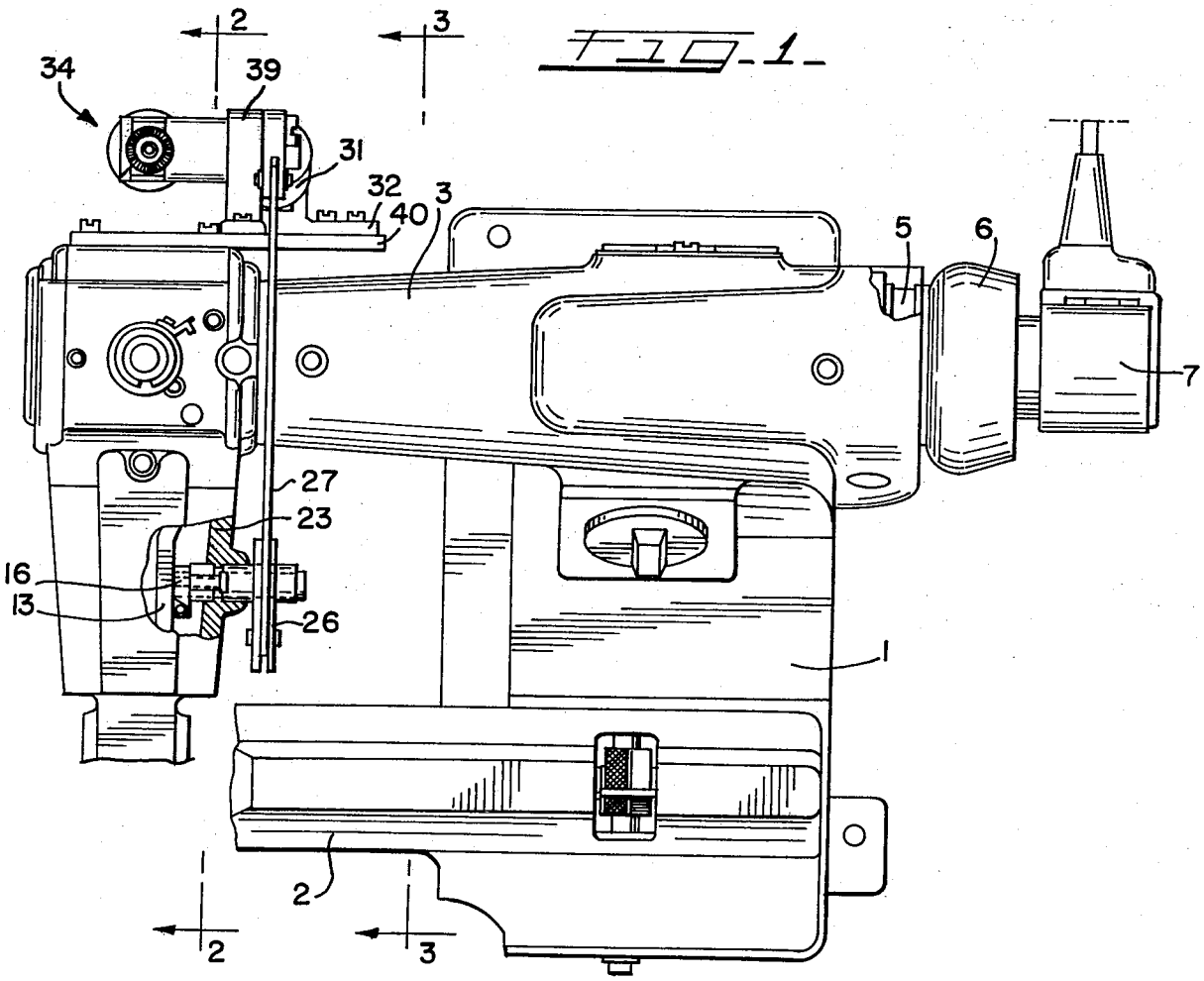
FIG. 1 is a top plan view illustrating a blindstitch sewing machine incorporating the present invention.

Referring particularly to the drawings, wherein like reference numerals indicate like parts throughout the several views, the invention is applied to a blindstitch sewing machine which is adapted to produce a single thread chain stitch sewing operation of the type well known in the art. The sewing machine is provided with a conventional frame including a base 1 having a standard rising from the base, a work arm 2 and a bracket arm 3 extending laterally from the standard. Extending through and journaled in the bracket arm 3 is the machine main shaft 4. The usual belt pulley 5 and handwheel 6 are mounted on the extended end of the main shaft 4. A suitable pulse generator or synchronizer 7 is also carried on the main shaft 4 for controlling various machine functions. Fixed with respect to the free end of the bracket arm 3, is an apertured throat plate 8 beneath which the work fabrics are directed during the sewing operation. Arranged for reciprocal movement above the throat plate 8 is a curved needle 9 that is adapted to cooperate with other suitable stitch forming instrumentalities so as to form a stitch in a material workpiece. An oscillatory ridge former 12 is carried in the work arm 2 and is adapted to forceably urge a ridge of fabric upwardly through an aperture in the throat plate and into the reciprocatory path of the curved needle 9. The sewing head 3 is also provided with a work feeding mechanism 10 which is adapted to engage and advance the fabrics past the needle 9. One or more work presser members or means 11 are disposed in opposition to the feed mechanism 10 and are adapted to support and maintain the workpiece evenly on each side of the ridge former 12.

The feed mechanism 10 of the machine includes two lever means 13 and 16. The lever 13 is fulcrumed at its central portion where it is pin connected as at 15 to the upper end of lever 16. Arranged on the mainshaft is an eccentric 14. The eccentric is embraced by one end of the lever 13 and is effective in combination with the fulcrum of lever 13, to convert the rotational movement of the drive shaft 4 into elliptical movement of a feed dog arranged at the distal end of lever 13.

Figure 4:
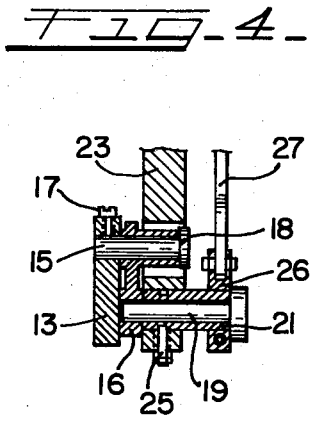
FIG. 4 is a sectional view taken along Line 4—4 of FIG. 2.
Figure 2:
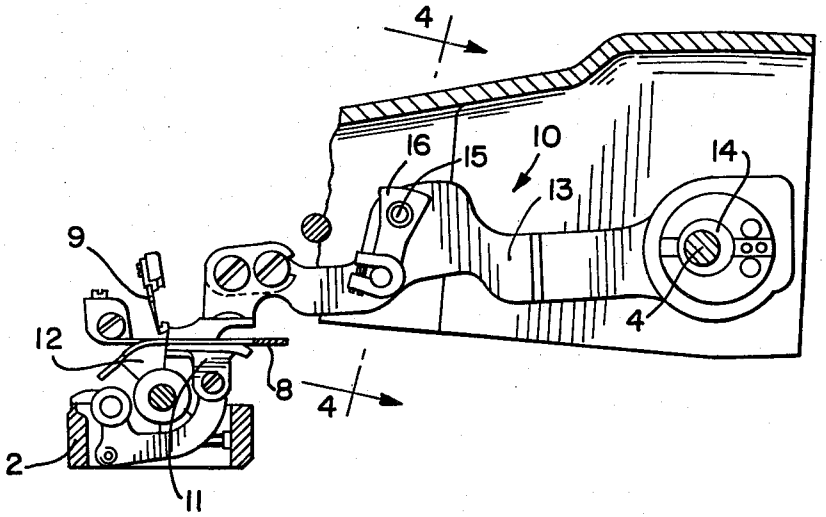
FIG. 2 is a sectional view taken along Line 2—2 of FIG. 1.
Figure 3:
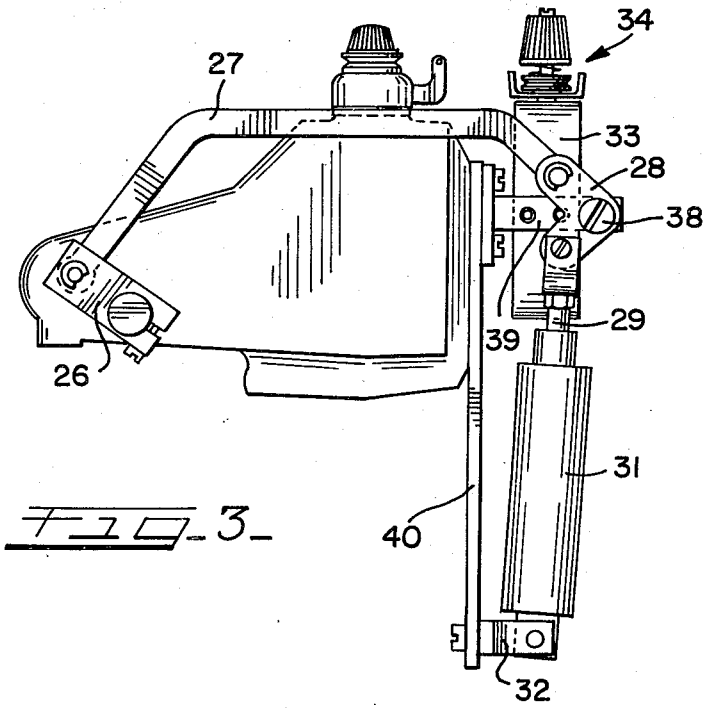
FIG. 3 is a side elevational view showing a portion of the sewing machine and illustrating the present invention.
Figure 5:
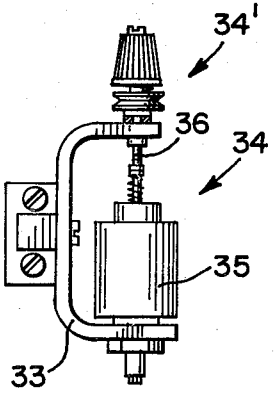
FIG. 5 is a view illustrating the needle thread auxiliary tension means of the present invention.

As shown in FIG. 4, the pin 15 is secured to the arm or lever 13 by screw 17. Lateral movement of the lever 16 is confined between the arm 13 and the shoulder 18 formed on the free end of pin 15. The depending end of lever 16 is received on one end of an elongated, shouldered pin 19. Telescopically, arranged on the pin 19 is an eccentrically apertured sleeve 21. The sleeve 21 is received in and extends through an aperture formed in the casing wall 23 of arm 3. The sleeve 21 has an annular groove about its periphery which is engaged by a set screw 25. Thus, the sleeve is allowed to rotate about its longitudinal axis but is prevented from axial displacement along its axis. The sleeve 21 has secured thereto, exteriorly of the machine frame, a lever 26 which is connected to a draw rod 27. At its other end, the draw rod is articulated to one arm of a bell crank lever 28. The other arm of the bell crank lever 28 is connected to the operative end 29 of an actuator means 31 which, in the performed embodiment, takes the form of an automatic spring return pneumatic cylinder. It is, therefore, clear that movement of the bell crank 28 through the energization of the actuator means 31 will cause the lever 26 to turn in a given direction causing rotation of the sleeve 21. As a result of the turning motion of sleeve 21, the eccentrically arranged pin 19 is displaced and through the interconnecting lever 16, the fulcrum of lever 13 is transposed as a function of the angular orientation of lever 26.

The ball crank lever 28 is mounted for pivotal movement about a pin 38 which is threadably engaged with a bearing block 39. Both the bearing block 39 and the bracket 32 for the actuator 31 are mounted on an auxiliary plate 40 which, in turn, is secured to the frame of the machine.

Also mounted on the bearing block 39 is a C-shaped bracket means 33 which serves as a mounting for an auxiliary needle thread tension assembly means 34. The auxiliary tension means includes an actuator 35, a push rod 36 operatively connected to the operative end of the actuator 35 and a tension assembly 34' in the preferred embodiment, the actuator 35 may be in the form of an electromagnet. The actuator is normally biased in a retracted position, and, upon energization, releases the tension normally applied to the thread as it passes through the tension means 34'.

The machine is actuated by an electric motor (not shown) of the "motor-stop" type. As is well known in the industry, the operator controls the motor and thus the machine operation through a treadle. When desired, the stitch shortening and locking process may be triggered by "heeling" the treadle. When the stitch shortening and tacking process is triggered by the operator, a predetermined number of locking stitches may be formed in the workpiece. The number of stitches formed being preselectable on the control means of the motor and counted by the pulse generator 7.

When the stitch shortening and tacking process is triggered, the actuator 31 is energized and the bell crank lever 28 is rotated about its pivot 38. Movement imparted by bell crank lever 28 is transmitted through lever 27 to shift or move the arm 26 from a first position to a second position, thus causing the sleeve 21 to rotate. The rotation of sleeve 21 displaces the pin 19 due to the eccentricity of the sleeve, thus moving the lever 16.

Rotary motion of the main shaft 4 is converted into elliptical motion of the feed dog by the eccentric 14 and the fulcrum lever 13. The feed dog is, thus, always given an elliptical movement, but the path of movement is variable. When the lever 26 is in one position, the feed dog is adapted to engage and feed the workpiece past the needle over a first predetermined distance. When the actuator 31 is energized, however, it effects the fulcrumed position of the lever 13 through the transmittive linkages discussed above. The angle over which lever element 26 is rotated or turned determines the elevational position of fulcrum 15 and, thus, the effectiveness of the feed mechanism on the workpiece, and thereby the stitch length. That is, when the fulcrumed position of lever 13 is transposed through the actuation of the actuator 31, the elliptical path of the feed mechanism is altered and correspondingly its effectiveness on the workpiece. The effectiveness of the feed mechanism, of course, is directly related to the stitch length such that when the fulcrumed lever 13 is transposed, the workpiece may travel through a shortened distance relative to the predetermined distance it is adapted to pass through in normal operation. When desired, the feed mechanism may be adjusted to such a degree that the workpiece may remain in a generally fixed position relative to the needle 9. Although the stitch length or feeding effectiveness is altered, needle reciprocation continues and the workpiece may be penetrated a plurality of times by the needle over a shortened distance, this permitting a series of stitches to be arranged in close proximity relative to each other, thus effecting a locking or tacking operation whereby preventing the unraveling of previously formed stitches.

At the same time as of the effectiveness of the feed mechanism is altered or modulated, the auxiliary thread tensioning means 34 is effective. The actuator 35 is activated in timed response to the needle reciprocation. Thus, the tension assembly 34 controls the excess thread caused by the reduction in the amount of material fed when the stitch shortening and tacking operation is effective.

Thus, it is apparent that there has been provided, in accordance with the invention, a stitch shortening and tacking mechanism for a blindstitch sewing machine that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed:

1. In a blindstitch sewing machine having a rotary drive shaft, a reciprocatory needle, a throat plate, means for supporting a workpiece as it passes said needle and a feed mechanism for advancing the workpiece past said needle comprising:

fulcrumed lever means having a feed dog secured to one end thereof for engaging the workpiece and means for converting the rotational movement of the drive shaft into elliptical movement of the feed dog, and operator controlled eccentric actuating means for transposing the fulcrumed position of said lever means whereby shifting the path of elliptical movement of the feed dog thereby altering the effectiveness of the workpiece advancement.

2. In a blindstitch sewing machine having stitch forming instrumentalities for forming a stitch in a workpiece, apertured throat plate means, means supporting the workpiece beneath said throat plate means and a feed mechanism means comprising:

means movable into engagement with the workpiece for moving same past said needle; and operator controlled means for altering the effectiveness of said means movable during sewing so that upon command the workpiece will remain in a generally fixed position relative to the needle while the needle is reciprocated through the workpiece a plurality of times whereby forming a locked seam thus preventing unraveling of previously formed stitches.

3. In a blindstitch sewing machine having a free-ended bracket arm, reciprocal needle means arranged at the free end of said bracket arm, means for supporting a workpiece beneath said bracket arm and in the reciprocal path of said needle and a work feed mechanism means for advancing a workpiece past said needle including a fulcrumed lever means and capable of varying the stitch length while the machine is sewing comprising:

eccentrically apertured sleeve means rotatably mounted in the bracket arm;

pin means received in the eccentric aperture of said sleeve means;

operator controlled means in operative engagement with the sleeve means for turning said sleeve a controlled amount whereby displacing said pin means; and means interconnecting the pin means and the lever means for altering the fulcrumed position of said lever when said pin is displaced thus altering the effectiveness of the feed mechanism on said workpiece whereby effecting the stitch length.

4. In a blindstitch sewing machine according to claim 3 wherein said operator controlled means includes an actuator that is responsive to commands from a machine operator connected to the sleeve means through a series of linkages.

5. In a blindstitch sewing machine having a reciprocating needle means, means for supporting a workpiece in the reciprocatory path of said needle during a sewing operation and a feed mechanism means comprising:

first operative means movable between first and second positions;

fulcrumed feeder means movable into engagement with the workpiece for moving same through a first predetermined distance when said first operative means is in a first position; and second operative means operatively coupled to said first operative means for displacing the fulcrum of said feeder means when said first operative means is moved to its second position such that the feeder means is effective to advance the workpiece a shorter distance than said first predetermined distance whereby shortening the length of the stitch effected by said sewing operation.

6. The blindstitch sewing machine according to claims 3 or 5 further including an auxiliary needle thread tensioning means adapted to tension the thread supplied in response to needle reciprocation and effective when the second operative means is effective to shorten the length of the stitch.

* * * * *